United States Patent [19]

Parsons et al.

[11] Patent Number: 4,663,998

[45] Date of Patent: May 12, 1987

[54] MAGNETIC WRENCH SOCKET

[76] Inventors: Clifford L. Parsons, P.O. Box 516, Lyle, Wash. 98635; Myrtle A. Parsons, Box 2227, Columbia Falls, Mont. 59912

[21] Appl. No.: 783,613

[22] Filed: Oct. 3, 1985

[51] Int. Cl.[4] ..... B25B 13/02

[52] U.S. Cl. ..... 81/125

[58] Field of Search ..... 81/125, 13, 121.1; 335/285

[56] References Cited

U.S. PATENT DOCUMENTS 2,720,804 10/1955 Brown ..... 81/125

3,165,950 1/1965 Gooley et al. ..... 81/125

3,320,563 5/1967 Clark ..... 81/125

*Primary Examiner*—Frederick R. Schmidt

*Assistant Examiner*—Debra S. Meislin

*Attorney, Agent, or Firm*—Paul H. Gallagher

[57] ABSTRACT

A socket for a socket wrench set, having a magnet in the bottom thereof, releasably held therein by a C ring. The nut, or bolt head, fitted in the socket is held by the magnet, and the C ring spaces it slightly from the magnet for a cushioning effect. The socket has a bottom hole for insertion of the wrench shank, and the magnet serves also to hold the socket on the wrench. The socket is made of an alloy that counteracts the magnetic field in lateral direction.

1 Claim, 5 Drawing Figures

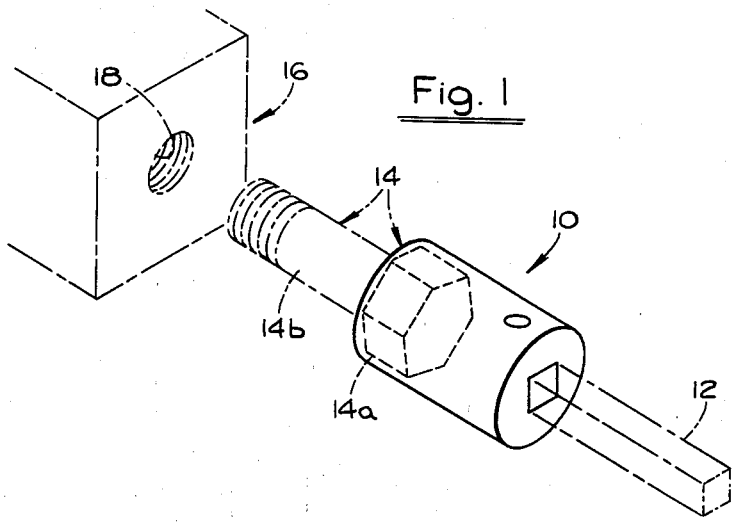
Fig. 1
Fig. 2
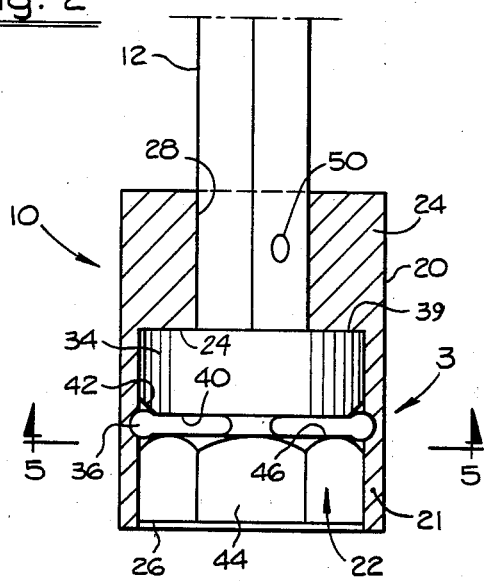
Fig. 3
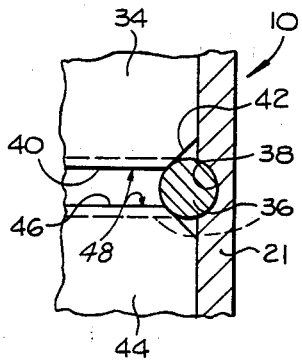
Fig. 4
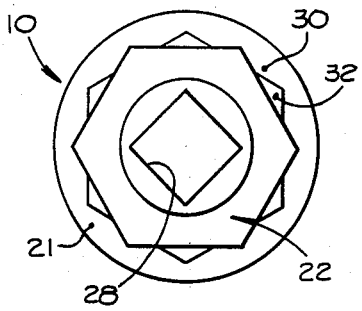
Fig. 5
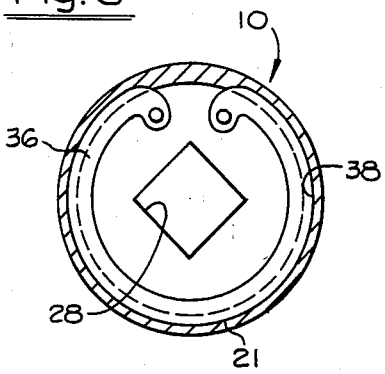

MAGNETIC WRENCH SOCKET

OBJECTS OF THE INVENTION

A broad object of the invention is to provide a socket for a socket wrench set, that is capable of easily holding an object article therein, such as a nut, so as to facilitate putting it in an operable position by manipulating the wrench on which it is fitted.

A more specific object is to provide a socket of the foregoing character that includes a magnet therein utilized for holding the object.

Another object is to provide such a socket that may be utilized also for holding the socket, and the object therein, on the wrench.

A further object is to provide a socket of the foregoing character wherein the socket is of an alloy effective for counteracting the magnetic field of the magnet, in lateral direction.

DESCRIPTION OF A PREFERRED EMBODIMENT

In the drawings,

FIG. 1 is a perspective view of the socket made according to the present invention, in association with other elements that are shown in dot-dash lines;

FIG. 2, is an axial sectional view of the socket and other elements therein;

FIG. 3 is a large scale sectional view of a portion of FIG. 2 indicated by the arrow 3;

FIG. 4 is an end view taken from the lower end of FIG. 2; and

FIG. 5 is a sectional view taken at line 5—5 of FIG. 2.

Referring in detail to the accompanying drawings, the wrench socket of the invention is indicated as a whole at 10 in FIG. 1. It is shown in association with the shaft 12 of a wrench on which it is to be mounted, and holding the object to be applied in position, in this case constituted by a bolt 14 shown in dot-dash lines; this figure also shows an article 16 having a threaded hole 18 into which the bolt 14 is to be inserted.

The socket 10 includes a shell 20 having a surrounding wall 21, a recess 22 limited at its inner end by an end wall 24, and having an open outer end 26. The end wall 24 is provided with a polygonal hole 28, which may be square or hexagonal according to the shape of the shank of the wrench to be used.

The recess 22 at its outer end portion is provided with a series of axially extending ribs 30 forming grooves 32 therebetween, in a known manner, for receiving a nut or bolt head, etc., which very often is hexagonal in shape.

Constituting a principal feature of the invention, is a magnet 34, which is a button magnet, of shorter length than the depth of the recess, and positioned at the inner end thereof. The magnet is polarized in directions longitudinally of the socket.

The magnet 34 is detachably positioned in the recess, and held in the inner end portion thereof by means of a C ring 36 releasably held in a peripheral groove 38 formed in the wall 21, in the recess, at the inner end of the grooves 32. The magnet is preferably cylindrical in shape, having an inner end surface 39 engaging the end wall 24, and an outer end surface 40 which is generally flat, but may have a chamfer 42 at its peripheral edge which engages the ring 36, so that the main portion of the surface 40 may extend axially or longitudinally beyond the adjacent surface of the ring.

As mentioned above, the object 14, in the usual use of a socket wrench set, is ordinarily a nut or a bolt. In the case of the bolt 14, in FIG. 1, the bolt head **14*a* is fitted in the recess and the shank 14*b* of the bolt extends from the recess in position to be applied in place, such as threaded into the hole 18 in FIG. 1. The operation is essentially the same in applying a nut, and FIG. 2 shows such a nut 44. The nut has an inner surface 46, directed against the magnet, and when it is positioned in the recess, it engages the ring 36 in such position that the surface 46 is spaced from the surface 40 of the magnet, as indicated by the gap 48 in FIG. 3**.

FIG. 2 shows the socket applied to the shank 12 of the wrench, the latter being inserted in the hole 28. The shank 12 may be of presently known kind, such as one having detent elements 50 which are spring pressed outwardly to frictionally hold the socket on the shaft, as in previously known socket wrench sets. That same kind of shank may be utilized in the present case, but the socket of the present invention is also adapted for use with a shank 12 not having such detents 50, the arrangement being such that the shank 12 extends into the hole 28 into engagement with the magnet, or nearly so. In either case the magnet serves to hold the socket on the shank 12 while at the same time holding the nut in the recess. Accordingly the user, in using the device, applies the socket to the shank, and fits the nut in the recess, and can, with one hand, hold the wrench, and manipulate the free end thereof, i.e., the end with the socket held thereon, freely into position for applying the nut into position. The wrench may be so manipulated with one hand, or in certain instances held in one hand and guided with the other hand, but it is not necessary to use the second hand for holding the nut in the socket while the wrench is being so manipulated for applying the nut to its intended position. This renders it possible, and convenient, to reach many places that would be difficult or impossible to reach with the free end of the wrench while being held with the second hand.

While the preferred form of socket is that illustrated herein, namely, with the magnet releasably held in position, it is within the scope of the invention that the magnet be permanently secured in the socket. When the nut is applied in position, as threaded onto a bolt, it of course is released by the action of threading it onto the bolt.

It is understood that the magnet is used in connection with objects and articles that are magnetic in nature, that is, the nut 44 is ordinarily iron, and the shank 12 iron or steel.

The shell 20 is composed of a known kind of alloy. A common alloy used for this purpose contains chromium, or instead of using such an alloy, the shell may be chromium plated. The chromium functions to counteract the magnetic field in transverse direction, i.e., through the wall of the recess. This prevents any action by the magnet in causing attraction of the socket sideways, or transversely, of the longitudinal direction, thus eliminating any swaying the socket, and free end of the wrench, in corresponding directions, which would render it difficult to apply the nut to the intended bolt. In other words the free end of the wrench is easily moved as intended, by the hand holding the wrench.

The magnetic wrench socket of the invention can be made for use with both metric and standard dimensional nuts and bolts.

We claim:

1. A magnetic socket for a socket wrench set, adapted for use with an object that has an inner end with an end surface that is generally flat and positioned transversely, and that is of predetermined transverse dimensions and having an outer end, said magnetic socket comprising, a shell having a recess therein, the recess having a longitudinal axis and having an inner end and having an outer open end adapted for receiving said inner end of the object in the recess, and the shell being of such dimensions that the object substantially fills the recess in transverse directions, the shell having a transverse end wall element limiting the inner end of the recess, a magnet in the inner end of the recess operable for holding said object in the recess, and being a separate element from the shell, the magnet having an outer end surface directed toward the outer end of the recess and having a circumferential chamfer surrounding said outer end surface, the shell having a circumferential groove in its inner surface intermediate the ends of the recess, and a ring detachably mounted in said groove, said ring extending radially inwardly beyond the inner surface of the recess, and also radially inwardly beyond the circumferential outer surface of the magnet, said ring having a longitudinal dimension extending along the longitudinal axis of the shell, the magnet and ring being so dimensioned and positioned that the chamfer of the magnet engages the ring, and the ring through that engagement is operable for retaining the magnet in the recess, and in such position therein that the outer end surface of the magnet terminates within the longitudinal dimension of the ring, the ring being engageable by the object, when the object is in the recess, and the ring being thereby operable for limiting the movement of the object into the shell, the magnet and ring being so positioned, dimensioned, and proportioned that the ring is operable for spacing the magnet from the object to provide a gap therebetween.

* * * * *